United States Patent [19]

Yonezu

[11] 4,058,151

[45] Nov. 15, 1977

[54] AUTOMATIC LUMBER FEEDING DEVICE IN COMBINATION WITH A WOOD WORKING MACHINE

[75] Inventor: Nobuya Yonezu, Nagoya, Japan

[73] Assignee: Minami Kogyo Kabushiki Kaisha, Inuyama, Japan

[21] Appl. No.: 728,891

[22] Filed: Oct. 4, 1976

[30] Foreign Application Priority Data

Oct. 3, 1975 Japan ..... 50-135807[U]

[51] Int. Cl.[2] ..... B27B 31/00; B27C 1/12

[52] U.S. Cl. ..... 144/246 E; 144/246 C; 198/722

[58] Field of Search ..... 198/722, 782; 144/242 R, 245 R, 246 R, 246 A, 246 B, 246 C, 246 E, 247, 249 R, 250, 250 A

[56] References Cited

U.S. PATENT DOCUMENTS 2,780,253 2/1957 Joa ..... 144/246 C

FOREIGN PATENT DOCUMENTS 973,800 6/1960 Germany ..... 144/246 R

*Primary Examiner*—Harrison L. Hinson
*Assistant Examiner*—W. D. Bray

[57] ABSTRACT

An automatic lumber feeding device to be used in combination with a wood working machine such as a hand feed planer or the like. The lumber feeding device comprises a fixed bracket, a free bracket mounted to the fixed bracket at a certain angle and a roller shaft head arranged to be at right angles to the free bracket. The roller shaft head supports a rotatable roller shaft to which a feed roller is fastened. The free bracket is reciprocally movable along the fixed bracket in the longitudinal direction thereof, and the position of the roller shaft head relative to the free bracket is adjustable. The feed roller attached to the roller shaft is rotated by means of a driving motor or by other means so as to feed lumber with a surface thereof being pressed by a press surface of the feed roller. The lumber feeding device is attached to a ruler member vertically provided on a working table of a wood working machine.

2 Claims, 5 Drawing Figures

AUTOMATIC LUMBER FEEDING DEVICE IN COMBINATION WITH A WOOD WORKING MACHINE

BACKGROUND OF THE INVENTION

This invention relates to an automatic lumber feeding device to be used in combination with a wood working machine such as a hand feed planer or the like.

Conventionally, lumber to be worked by a wood working machine such as a hand feed planer or the like is placed on a table of the machine and is advanced manually or by means of a push jig in close contact with a ruler member on the machine. In such a manner, however, there is the possibility of injury and it requires a considerable amount of skill and experience to obtain an exactly straight lumber surface and a right-angled edge. An unskilled or inexperienced operator often fails to advance the lumber in close contact with the ruler member throughout the operation, resulting in production of useless products.

SUMMARY OF THE INVENTION

It is accordingly an object of this invention to provide an automatic lumber feeding device which achieves secure and effective advancement of lumber.

It is another object of this invention to provide an automatic lumber feeding device by means of which a desired straight lumber surface and a right-angled lumber edge can easily be obtained.

These and other objects and features of this invention will be clear from a reading of the following description of the disclosure found in the accompanying drawings and the novelty thereof pointed out in the appended claims.

DESCRIPTION OF THE PREFERRED EMBODIMENTS

Figure 1:
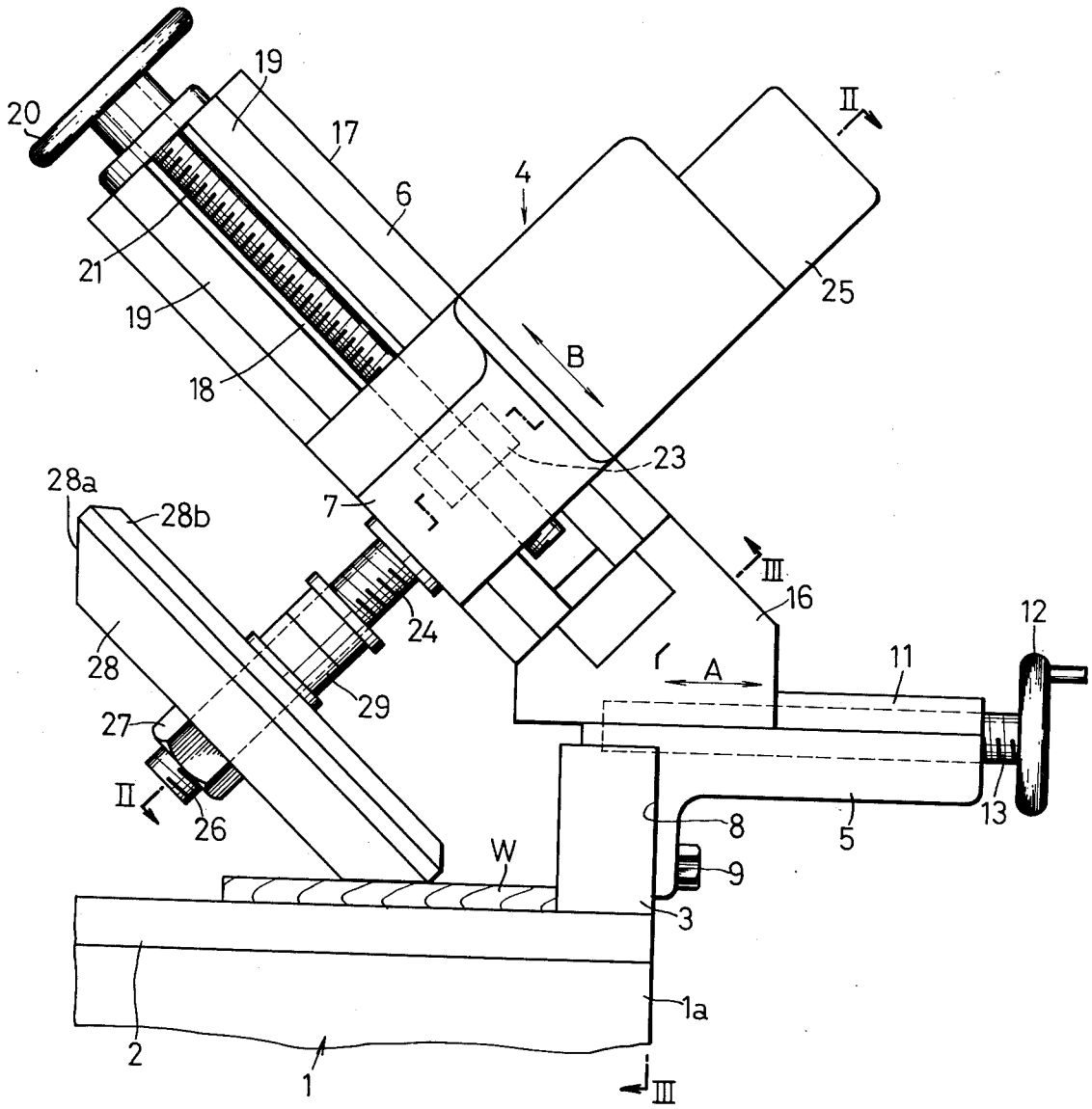
FIG. 1 is an elevational view of the lumber feeding device embodying this invention which may be in combination with a wood working machine.
Figure 2:
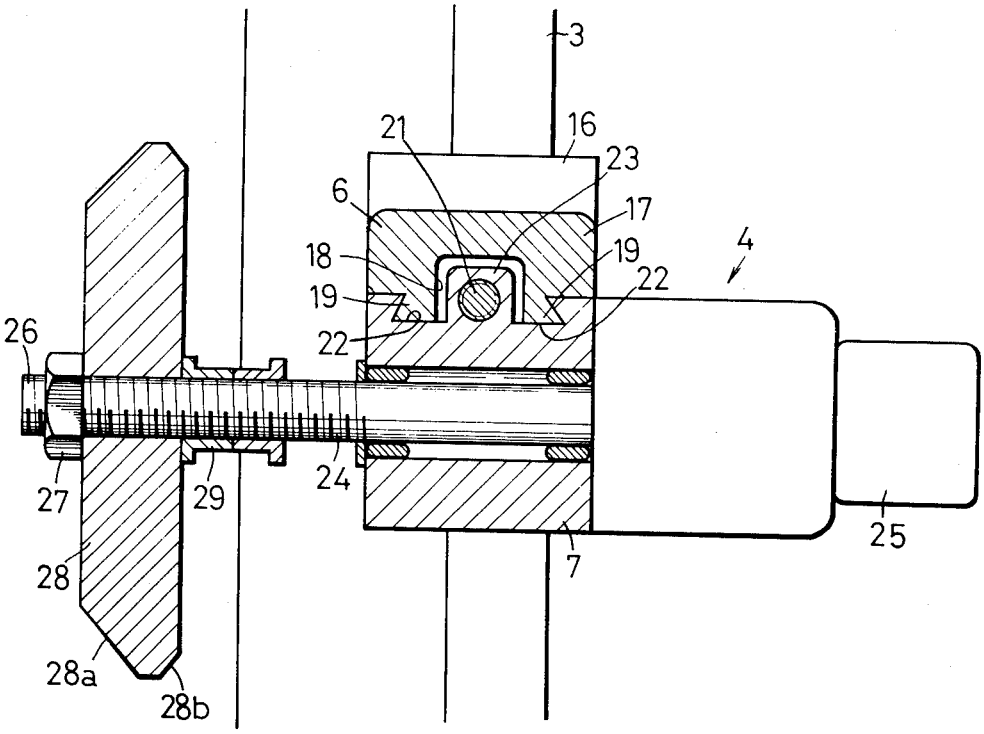
FIG. 2 is a sectional view taken along the line II—II of FIG. 1.
Figure 3:
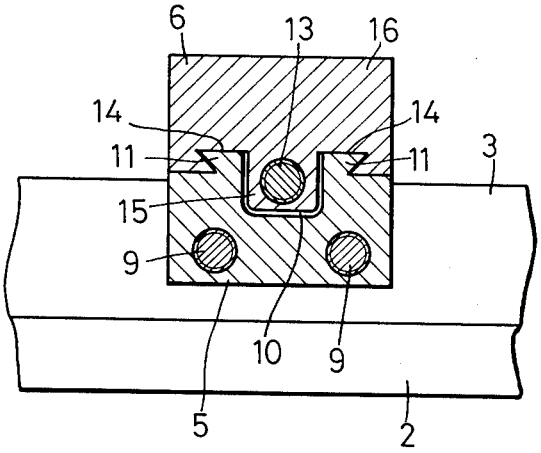
FIG. 3 is a sectional view taken along the line III—III of FIG. 1.

Referring now to the embodiment of the invention shown in the drawings, reference numeral 1 indicates a hand feed planer having a bed 1*a* on which a table 2 is arranged. A ruler member 3 is vertically provided on the table 2 at one edge thereof. The table 2 is divided in two in the middle thereof, i.e., the front part and the rear part, and between the two parts there is arranged a cutter head (not shown) which is rotated by a driving means (not shown) provided within the bed 1*a*.

A lumber feeding device 4 consists of a fixed bracket 5 which is fixed to the ruler member 3 of the planer 1, a free bracket 6 which is attached at an angle of 45° to the fixed bracket 5 and a roller shaft head 7 arranged to be at right angles to the free bracket 6. The fixed bracket 5 has a right angled portion 8 at which the fixed bracket 5 is horizontally fixed to the ruler member 3 of the planer 1 by means of bolts 9. A pair of dovetails 11, 11 is formed in parallel on the upper surface of the fixed bracket 5 and there is longitudinally provided a central groove 10 between the two dovetails 11, 11 on the upper surface of the fixed bracket 5. By rotating the threaded shaft 13 the free bracket 6 is reciprocally moved along the dovetails 11, 11 of the fixed bracket 5. Within the groove 10 there is rotatably supported a threaded shaft 13 having a handle 12 at one end thereof. While, the free bracket 6 is provided with two dovetail grooves 14, 14 which engage with the dovetails 11, 11 respectively. The free bracket 6 further comprises a reciprocating member 16 provided with a boss 15 into which the threaded shaft 13 is engaged and a strut piece 17 which is attached to the reciprocating member 16 in an inclined condition. On one side surface of the strut piece 17 there is longitudinally provided a groove 18 and there are formed a pair of dovetails 19, 19 in parallel on both sides of the groove 18. A threaded shaft 21 having handle 20 is rotatably supported within the groove 18. The above mentioned roller shaft head 7 is provided with two dovetail grooves 22, 22 which engage with the dovetails 19, 19 of the free bracket 6 respectively and a boss 23 into which the threaded shaft 21 is screwed, and this roller shaft head 7 is reciprocally mounted to the free bracket 6. Further, the roller shaft head 7 supports a rotatable roller shaft 24 at an angle of 45° in respect to said ruler member 3. One end of the roller shaft 24 is connected through a reduction means (not shown) to a driving motor 25 attached to the roller shaft head 7, and the opposite end of the roller shaft 24 is threaded and positioned above the aforementioned table 2. A feed roller 28 is fastened to the threaded portion 26 of the roller shaft 24 by means of nuts 27 and 29. The position of the feed roller 28 is adjustable along the roller shaft 24. The surface of the feed roller 28 is made of rubber or the like and forms press surfaces 28*a* and 28*b* which are parallel to the table 2 and the ruler member 3 respectively. Reference W indicates a lumber to be worked.

The feeding device 4 according to this invention is constructed as described above. In case of feeding a flat lumber W as shown in FIG. 1, keeping the flat surface thereof in contact with the table 2, the handle 12 is to be turned to rotate the threaded shaft 13 and accordingly the free bracket 6 is moved reciprocally along the fixed bracket 5 in the direction of an arrow A in FIG. 1 (with the dovetails 11 of the fixed bracket 5 being engaged with the dovetail grooves 14 of the free bracket 6). On the other hand, when the handle 20 is turned to rotate the threaded shaft 21, the roller shaft head 7 together with the roller shaft 24 are moved reciprocally along the free bracket 6 in the direction of an arrow B in FIG. 1, with the dovetails 19 of the strut piece 17 being engaged with the dovetail grooves 22 of the roller shaft head 7. Thus, the feed roller 28 attached to the roller shaft 24 is positioned above the lumber W which is placed on the table 2 and the upper surface of the lumber W is pressed by the press surface 28*a* of the feed roller 28 at an angle of 45° as shown in FIG. 1.

Then, the roller shaft 24 is rotated by the driving motor 25 through the reduction means and accordingly the feed roller 28 is also rotated so that the lumber W is automatically fed while being pressed against the table 2 from the direction of 45°. During the feeding, the lumber is worked by a tool (not shown). In this case, the lumber W is not only pressed against the table 2 but also pressed against the ruler member 3, so that the lumber W is steadily fed along the ruler member 3. Therefore, the under surface of the lumber W is safely and automatically planed to be at right angles to the side surface thereof contacted with the ruler member 3.

Figure 4:
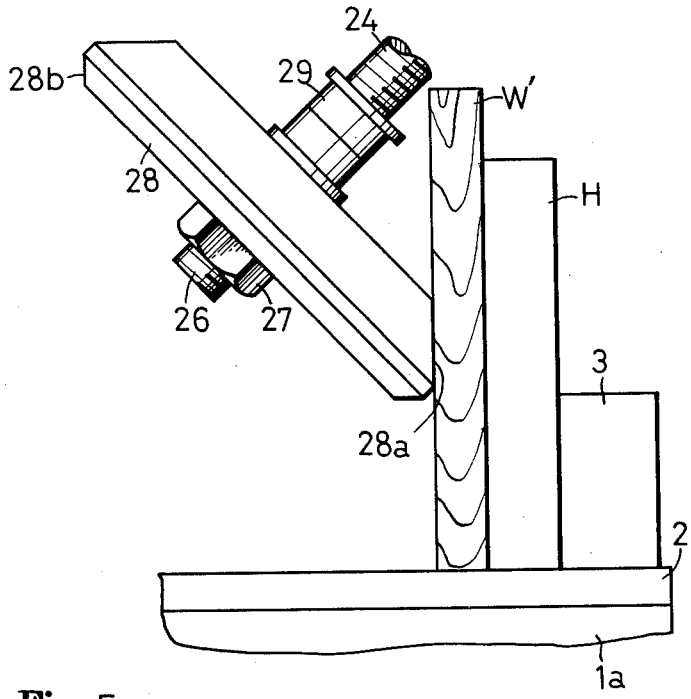
FIGS. 4 and 5 are respective elevational views showing different manners for feeding the lumber to be worked.

In case of feeding a flat lumber W' with the flat surface thereof being kept in contact with the ruler member 3 as shown in FIG. 4, the feed roller 28 is attached to the roller shaft 24 reversely so as to direct the press surface 28*a* to the side of ruler member 3. Then, the free bracket 6 and the roller shaft head 7 are moved in the same manner as mentioned hereinbefore and accordingly the flat surface of the lumber W' is pressed by the press surface 28*a* of the feed roller 28. After that, the feed roller 28 is rotated in the same manner as mentioned hereinbefore so as to feed the lumber W', keeping it in contact with the ruler member 3. In this case, a guide plate H may be placed between the lumber W' and the ruler member 3 as shown in FIG. 4.

Figure 5:
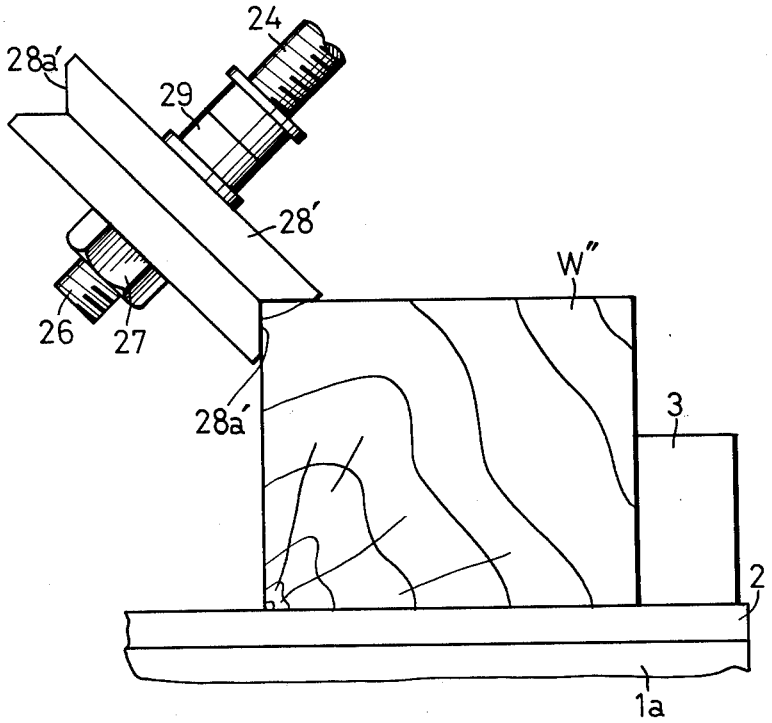

Further, in case of feeding a square lumber W" as shown in FIG. 5 too, it is of course possible to feed the lumber W" by pressing it with the feed roller 28. In this case, however, it is desirable to use a feed roller 28' having a V-shaped press surface 28*a'* which is right-angled. Namely, the feed roller 28' is attached to the roller shaft 24 in the same manner as mentioned before, so as to press the press surface 28*a'* against a corner of the lumber W" and accordingly the upper surface and the side surface of the lumber W" are simultaneously pressed by the feed roller 28'. Then, in the same manner as mentioned hereinbefore, the feed roller 28' is rotated and the lumber W" is fed with a side surface thereof being kept in contact with the ruler member 3.

Besides the embodiments described hereinbefore, it is anticipated to apply the following techniques in this invention:

a. To use the lumber feeding device in combination with wood working machine having a ruler member 3 other than the planer;

b. To attach the fixed bracket 5, not to the ruler member 3, but to the bed of the wood working machine;

c. To fix the free bracket 6 to the fixed bracket 5 and adjust the position of the feed roller 28 relative to the lumber W by moving the roller shaft head 7 and moving the feed roller 28 in relation to the roller shaft 24;

d. To set the angle of the roller shaft 24 relative to the ruler member 3 at a certain angle other than 45°; and e. To remove the driving motor 25 and manually operate the feed roller 28.

Obviously many modifications and variations of the present invention are possible in the light of the above teachings. It is therefore to be understood that within the scope of the appended claims the invention may be practiced otherwise than as specifically described.

What I claim is:

1. A lumber feeding device to be used in combination with a wood working machine having a table on which lumber to be worked is placed; a ruler member provided on said table, said ruler member having an operative surface thereon which is vertically disposed, said device having a fixed bracket adapted to be secured to said ruler member of said wood working machine, said fixed bracket consisting of a pair of dovetails in parallel on the upper surface thereof, a central groove longitudinally extended between said dovetails and a threaded shaft rotatably supported within said groove which is rotated by turning a handle provided to the outer end thereof, a moveable bracket consisting of a reciprocating member having two dovetail grooves which engage, respectively, with said dovetails of said fixed bracket, said reciprocating member having a boss into which said threaded shaft is engaged, a strut piece secured to said reciprocating member in an inclined condition in respect to said fixed bracket, said strut piece being longitudinally provided with a groove and a pair of dovetails in parallel on both sides of said strut piece groove, a second threaded shaft rotatably supported within said strut piece groove, a roller shaft head arranged to be at right angles to and reciprocally movable along said strut piece, said roller shaft head being provided with two dovetail grooves which engage, respectively, with said dovetails of said strut piece, said roller shaft head having a boss into which said second threaded shaft is engaged, a roller shaft rotatably supported by said roller shaft head, and a feed roller attached to said roller shaft, whereby said feed roller can press at least one surface of said lumber and feed the same along the operative surface of said ruler member.

2. A lumber feeding device to be used in combination with a wood working machine having a table on which lumber to be worked is placed; a ruler member provided on said table, said ruler member having an operative surface thereon for bearing against a surface of said lumber, a rotative roller shaft arranged at an angle in relation to said ruler member of said wood working machine, a feed roller is attached to said roller shaft to be positioned above said table of said wood working machine so as to press a surface of said lumber and feed the same along said ruler member of said wood working machine, said device comprising a fixed bracket fastened on said wood working machine, a moveable bracket moveably carried on said fixed bracket and reciprocable relative thereto, said moveable bracket including a strut piece disposed in an inclined position above said table of said wood working machine, a moveable head moveably carried on said strut piece and reciprocable relative thereto, said roller shaft rotatably supported on said head, and said roller having at least one press surface thereon disposed at a predetermined position in respect to the operative surface of said ruler member.

* * * * *